United States Patent [19]

Rath

[11] 4,151,670

[45] May 1, 1979

[54] FIRING MECHANISM FOR SEMI-AUTOMATIC FIREARMS

[76] Inventor: Hans M. Rath, 116 Sproul La., Staunton, Va. 24401

[21] Appl. No.: 840,728

[22] Filed: Oct. 11, 1977

Related U.S. Application Data

[63] Continuation-in-part of Ser. No. 685,651, May 12, 1976, Pat. No. 4,056,038.

[51] Int. Cl.[2] ..... F41C 17/02

[52] U.S. Cl. ..... 42/70 E; 42/69 B; 42/70 R

[58] Field of Search ..... 42/69 B, 69 R, 70 E, 42/70 R, 70 C, 16, 1 C

[56] References Cited

U.S. PATENT DOCUMENTS

| | | | |
|---|---|---|---|
| 2,600,176 | 6/1952 | Williams | 42/69 B |
| 2,922,241 | 1/1960 | Brunelle | 42/69 B |
| 3,029,708 | 4/1962 | Marchisio | 42/69 B |
| 3,167,877 | 2/1965 | Jungeling | 42/69 B |
| 3,314,183 | 4/1967 | Center | 42/69 B |
| 3,662,483 | 5/1972 | Seecamp | 42/69 B |
| 4,056,038 | 1/1977 | Rath | 42/16 |

FOREIGN PATENT DOCUMENTS

| | | | |
|---|---|---|---|
| 1410023 | 10/1975 | United Kingdom | 42/69 B |

*Primary Examiner*—Charles T. Jordan
*Attorney, Agent, or Firm*—B. P. Fishburne, Jr.

[57] ABSTRACT

A firing mechanism for semi-automatic firearms features simplicity of construction and reliability with safety. Essentially, the firing mechanism consists of a trigger, sear, hammer and safety. Preferably, the firing mechanism also includes a convenient safety blocking lever including an extension which, under proper circumstances, protrudes inside of the trigger guard to be felt by the finger of the shooter to assure him that the gun is cocked. In another position, the safety blocking lever disables the safety and the shooter, not being able to shift the safety, is assured that the firearm is not cocked and not ready to fire.

6 Claims, 6 Drawing Figures

FIRING MECHANISM FOR SEMI-AUTOMATIC FIREARMS

CROSS-REFERENCE TO RELATED APPLICATION

This application is a continuation-in-part of prior copending application Ser. No. 685,651, filed May 12, 1976, now U.S. Pat. No. 4,056,038.

BACKGROUND OF THE INVENTION

The invention seeks to satisfy the ever-present need for a simpler, more reliable, safer, and less expensive firing mechanism particularly for semi-automatic firearms. More particularly, the invention seeks to provide an improved mechanism basically as disclosed in the referenced prior application and having a new feature of convenience to the user of the firearm, namely, a safety blocking lever which enables the user to feel with his or her trigger finger whether or not the gun is cocked and ready to fire.

Additionally, an objective of the invention is to minimize the number of essential parts in the firing mechanism without loss of any operational capabilities, safety or convenience. More particularly, the mechanism of the invention eliminates a part present in the known prior art without loss of its function.

Examples of the known prior art are contained in U.S. Pat. Nos. 3,314,183; 3,608,224; 3,292,492 and 3,662,483.

The firing mechanism in U.S. Pat. No. 3,314,183, issued to W. A. Center, consists essentially of a hammer, sear, sear latch and trigger. The present invention eliminates entirely the sear latch of the Center patent by providing an elongated opening in the sear enabling it to have limited relative movement with the trigger while on a common fixed pivot therewith.

Other features and advantages of the invention will become apparent during the course of the following description.

DETAILED DESCRIPTION

Figure 1:
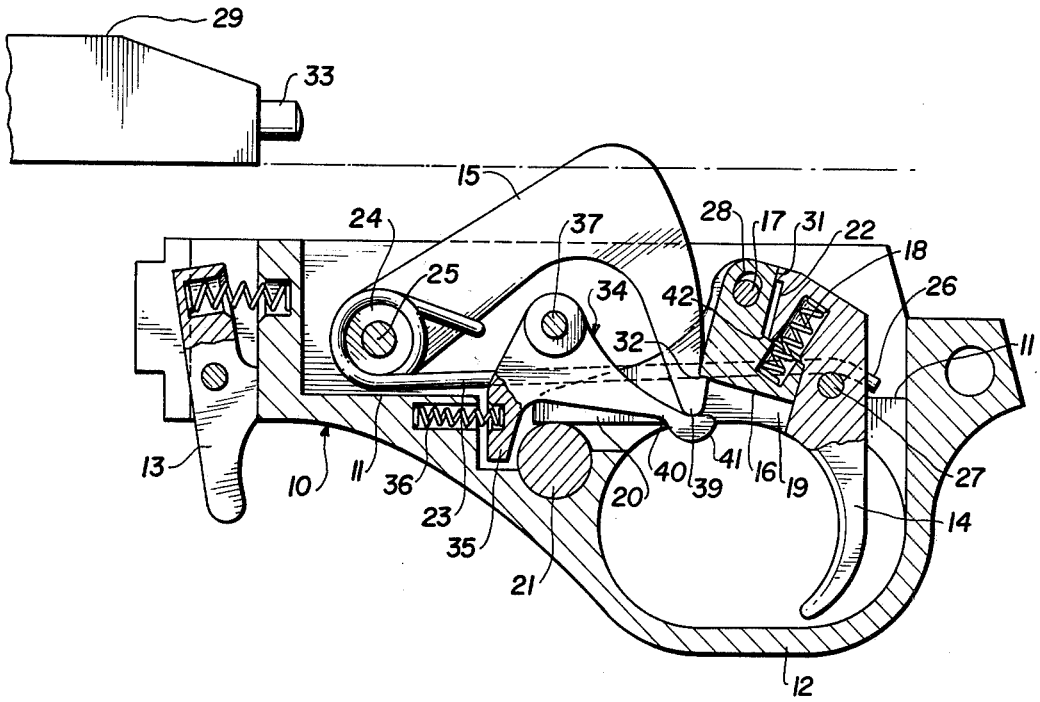
FIG. 1 is a vertical cross section through a firing mechanism for semi-automatic firearms in accordance with the invention with the hammer cocked, safety "on" and the knob of the safety blocking lever protruding into the trigger guard.

The disclosure of the above-referenced application, now U.S. Pat. No. 4,056,038, is incorporated herein by reference for the sake of simplifying the drawing illustrations in this application.

Referring to the drawings in detail wherein like numerals designate like parts, an improved firing mechanism for semi-automatic firearms is illustrated including a housing 10 having a bottom wall 11 and the customary trigger guard 12 formed integrally therewith. The housing 10 with the firing mechanism is adapted for mounting in the receiver portion of a semi-automatic rifle, in the manner disclosed in U.S. Pat. No. 4,056,038. At its forward end, the housing 10 carries a spring-urged magazine latch 13 for the purpose fully disclosed in said patent.

The firing mechanism on the housing 10 comprises a trigger 14, a hammer 15 and a sear 16 as essential elements. The sear and trigger are mounted on a common pivot pin 17 fixed to the housing 10. The sear 16 and a sear spring 18 are disposed within a cavity 19 of the trigger 14.

The trigger has a forward extension 20 integral therewith to cooperate with a safety 21 which is axially shiftable between "on" and "off" positions in the manner fully disclosed in the above-referenced patent. The sear spring 18 forces the sear 16 to pivot about the pin 17 in a clockwise direction, which movement is limited by contact of the sear with a surface 22 of the trigger 14. A torsion spring 23 mounted on a cylindrical pivot hub 24 of the hammer 15 forces the hammer into counterclockwise rotation about a fixed hammer pivot pin 25, and serves also as a trigger spring, by means of rearwardly extending spring legs 26 bearing on top of a transverse protruding pin 27 in the trigger 14, forcing the trigger in a clockwise direction about its pivot pin 17. The pin 27 also serves as a stop for the trigger by engagement with the bottom wall 11 of the trigger housing.

Figure 3:
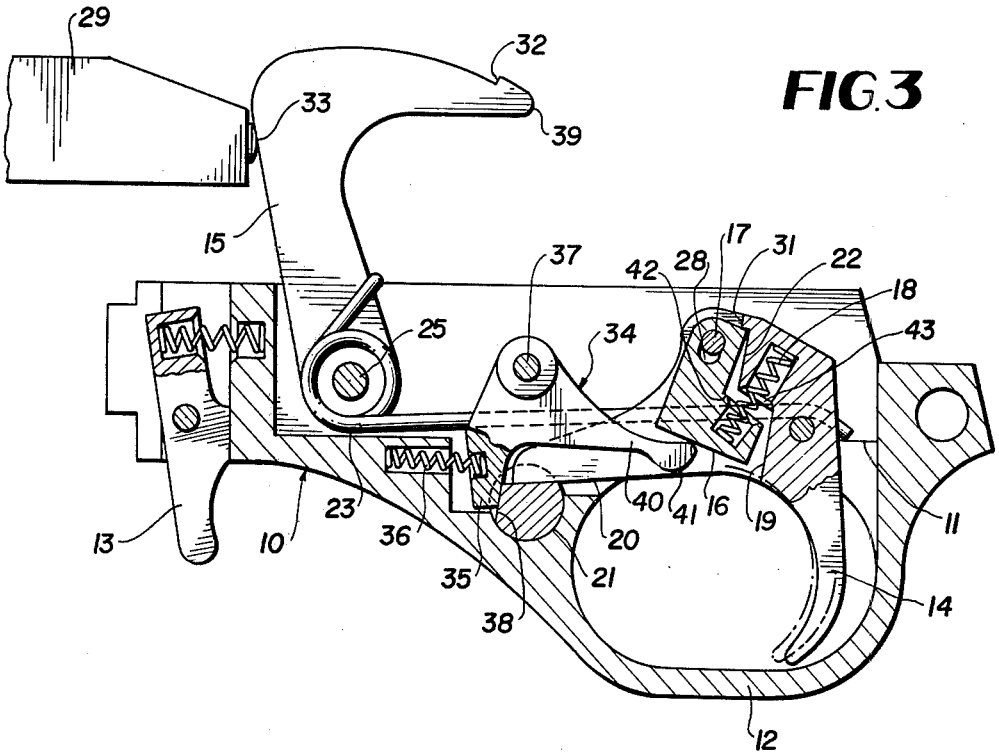
FIG. 3 is another cross sectional view of the mechanism in the firing position, with the safety "off", and blocked, the trigger depressed and the sear ready to catch the hammer, and the knob of the safety blocking lever being outside of the trigger guard.
Figure 4:
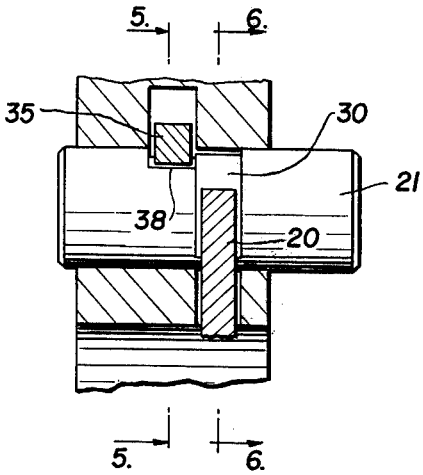
FIG. 4 is a fragmentary plan view of the safety with parts in section.

An elongated opening or slot 28 in the upper portion of the sear 16 allows the necessary movement of the sear on the fixed pin 17 to catch the hammer 15, FIG. 3, whether the trigger is depressed or not. The sear 16 is roughly L-shaped to fit compactly in the cavity 19 of the trigger, with the sear spring 18 substantially enclosed and held captive in opposing recesses of the sear and trigger, as illustrated.

In FIG. 1, the safety 21 is shown "on" and the hammer is engaged by the sear 16. The trigger extension 20 rests firmly on the safety 21 and the trigger cannot be depressed or pulled. The bolt 29 of the semi-automatic firearm is shown in the "home" position as disclosed in the referenced patent.

Figure 2:
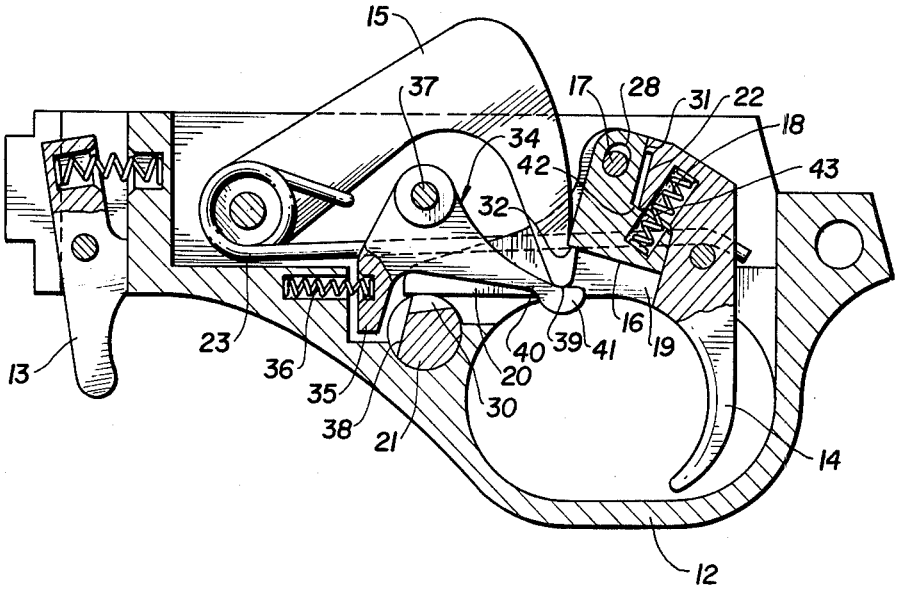
FIG. 2 is a similar cross sectional view of the firing mechanism, ready to fire, with the safety "off", and with the knob of the safety blocking lever continuing to protrude into the trigger guard.

FIG. 2 shows the safety 21 "off" and the hammer 15 engaged by the sear 16. By depressing the trigger 14, trigger extension 20 can now enter the notch 30 of the axially shiftable safety 21.

The sear 16 and trigger 14 are now able to rotate counterclockwise on the common pivot pin 17. A trigger nose 31 at the top of the trigger forces the sear 16 off of the hammer nose 32 or shoulder, permitting the hammer 15 to fly forwardly under influence of the spring 23 and strike the firing pin 33 in bolt assembly 29. At the firing cycle, when the trigger is depressed, as in FIG. 2, the sear 16 is forces downwardly on the pin 17 by the sear spring 18 through a distance limited by the length of the elongated opening 28, and the sear then rests on the trigger surface 22 as illustrated in FIG. 3. When the hammer is again forced downwardly by retraction of the bolt 29, FIG. 1, its nose 32 engages the sear 16 in this latter position of the sear shown in FIG. 3. When the trigger 14 is permitted to return to its normal position shown in FIG. 2, the sear 16 again moves upwardly on the fixed pin 17 by virtue of the elongated opening 28 and rests again against the trigger nose 31 and is spaced from the surface 22. This concludes the mechanism firing cycle. As thus far described, the firing mechanism is fully disclosed in copending application Ser. No. 685,651, now U.S. Pat. No. 4,056,038.

Figure 5:
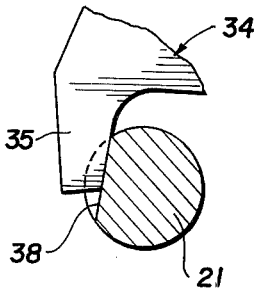
FIG. 5 is a vertical section taken on line 5—5 of FIG. 4.
Figure 6:
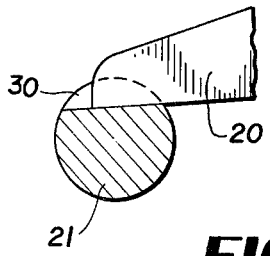
FIG. 6 is a similar section taken on line 6—6 of FIG. 4.

For additional convenience and safety, a safety blocking lever 34 has been added to the firing mechanism. Again, FIG. 3 shows the hammer 15 forward in the firing position. This is the case when the gun has been stored away or "dry fired". A depending leg 35 of the safety blocking lever 34, forced by a spring 36 into counterclockwise rotation about a fixed pivot pin 37 on the housing 10, has entered a notch 38 in the safety 21. Pivotal movement of the safety blocking lever 34 is limited by contact with the back face of notch 38 in the safety. At this time, the safety blocking lever through its leg 35 blocks the safety 21 positively from being shifted axially by the shooter, FIGS. 3 and 5. Not being able to shift the safety 21 gives the shooter the assurance that the firearm is not cocked and not ready to fire.

FIG. 2 shows the hammer cocked and the safety "off". Hammer nose or tip 39 presses on the leg 40 of safety blocking lever 34 against the force of compression spring 36, forcing the leg 35 of the safety blocking lever out of notch 38 in safety 21. Now, the safety can be shifted "on" and "off". An enlargement 41 on the rear end of leg 40 protrudes into the top of the trigger guard and can be felt by the trigger finger of the shooter, thus assuring him that the firearm is cocked and ready to fire.

Without the safety blocking lever 34, there could be a situation, when the safety is pushed "on", FIG. 1, where a sudden movement of the bolt through a loading cycle would result in damage to the hammer, sear or trigger, because the trigger extension 20 could not move into the notch 30 of the safety. The sear 16 is blocked in the trigger and cannot pivot out of the way of the hammer nose 32. In this latter respect, FIGS. 1 and 2, when the top of elongated sear opening 28 is above the pin 17, two opposing faces 42 and 43 of the sear and trigger are solidly engaged, as compared to the arrangement in FIG. 3 where the two faces 42 and 43 are separated when the bottom of the opening 28 is below the pin 17.

It should be understood that, while the safety blocking lever 34 is a convenient feature which should be provided on a quality firearm, nevertheless it is not essential to the basic firing mechanism and could be omitted in some instances. As stated, the elemental and essential components of the mechanism consist of the trigger, sear, hammer and safety, as described. With this combination of elements constructed according to the invention and with the safety 21 "on", there is no danger of a shot firing accidentally even if the firearm is dropped from a great height. One of the main parts would actually have to fail in order to release the hammer for firing and this is virtually an impossibility, as a practical matter.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A firing mechanism for semi-automatic firearms comprising a housing means adapted for placement in a firearm receiver, a hammer having a hammer spring and being pivotally mounted on the housing means, a trigger, a sear associated with the trigger, a common pivot element for the trigger and sear on said housing means, the sear having an elongated opening receiving said common pivot element whereby the sear is shiftable within fixed limits on the common pivot element relative to the trigger, a sear spring urging the sear rotationally in one direction on the common pivot element relative to the trigger, said hammer including a hammer nose adapted to catch the sear below the common pivot element when the sear is in an upper position on the common pivot element, said trigger having a trigger nose adapted to then abut the back of the sear and the trigger having a recessed face below the trigger nose to engage the back of the sear when the sear is in a lowered position on the common pivot element, a safety on said housing means and having "on" and "off" positions, an extension on the trigger adapted to engage said safety in the "on" and "off" positions thereof, said trigger having a cavity within which said sear is disposed, a pair of surfaces, one on said sear and one in the trigger cavity adapted to abut solidly when the sear is in said upper position and the trigger nose is abutting the back of the sear, and said sear spring disposed across said abutting surfaces of the sear and trigger and urging the sear rotationally in a direction to move the back of the sear against said trigger nose.

2. A firing mechanism for semi-automatic firearms comprising a housing means adapted for placement in a firearm receiver, a hammer having a hammer spring and being pivotally mounted on the housing means, a trigger, a sear associated with the trigger, a common pivot element for the trigger and sear on said housing means, the sear having an elongated opening receiving said common pivot element whereby the sear is shiftable within fixed limits on the common pivot element relative to the trigger, a sear spring urging the sear rotationally in one direction on the common pivot element relative to the trigger, said hammer including a hammer nose adapted to catch the sear below the common pivot element when the sear is in an upper position on the common pivot element, said trigger having a trigger nose adapted to then abut the back of the sear and the trigger having a recessed face below the trigger nose to engage the back of the sear when the sear is in a lowered position on the common pivot element, a safety on said housing means and having "on" and "off" positions, an extension on the trigger adapted to engage said safety in the "on" and "off" positions thereof, a safety blocking lever pivoted to said housing means and having a first leg adapted to engage said safety to prevent shifting of the safety and a second leg adapted to protrude into the space ahead of the trigger when the firearm is cocked, and a spring engaging said safety blocking lever and urging said one leg thereof toward said safety and the second leg thereof toward a non-protruding position relative to the trigger.

3. A firing mechanism for semi-automatic firearms as defined in claim 2, and an enlargement on the free end of the second leg of the safety blocking lever adapted to protrude into the top of the space encompassed by a trigger guard on the housing means.

4. A firing mechanism for semi-automatic firearms as defined in claim 2, and the second leg of the safety blocking lever lying in the path of movement of said hammer to be depressed to a protruding position by the hammer when the firearm is cocked whereby a trigger finger of a shooter may feel the protruding second leg and thereby be assured that the firearm is cocked.

5. A firing mechanism for semi-automatic firearms as defined in claim 2, and said safety comprising an axially shiftable member whose axis extends across said trigger extension and said first leg of the safety blocking lever, and said safety having a pair of notches therein adapted to receive the trigger extension and said first leg.

6. A firing mechanism for semi-automatic firearms as defined in claim 5, and said notches being circumferentially spaced and axially offset on said safety, said trigger extension and said first leg of the safety blocking lever extending roughly perpendicular to each other.

* * * * *